US005379736A

United States Patent [19]

Anderson

[11] Patent Number: 5,379,736

[45] Date of Patent: Jan. 10, 1995

[54] GAS COMPRESSOR/EXPANDER

[76] Inventor: Stanley R. Anderson, 64 Ravine Park Crescent, West Hill, Ontario, Canada, M1C 2M6

[21] Appl. No.: 279,878

[22] Filed: Jul. 25, 1994

[51] Int. Cl.[6] ..... F02G 3/00; F01C 1/00; F04C 2/00

[52] U.S. Cl. ..... 123/204; 418/161; 418/227

[58] Field of Search ..... 123/204; 418/160, 161, 418/164, 175, 225, 227

[56] References Cited

U.S. PATENT DOCUMENTS

| | | | |
|---|---|---|---|
| Re. 19,772 | 12/1935 | Dudley . | |
| 1,101,329 | 6/1914 | Reaugh . | |
| 1,279,912 | 9/1918 | Roberts . | |
| 2,136,066 | 11/1938 | Walters et al. . | |
| 2,688,874 | 9/1954 | Batchelder . | |
| 2,919,062 | 12/1959 | Tryhorn | 418/227 |
| 3,096,745 | 7/1963 | Thompson . | |
| 3,260,248 | 7/1966 | Lyle . | |
| 3,426,694 | 2/1969 | Marsh . | |
| 3,728,049 | 4/1973 | Miller | 418/227 |
| 3,756,755 | 9/1973 | Campbell . | |
| 3,989,011 | 11/1976 | Takahashi | 123/204 |
| 5,039,290 | 8/1991 | Nardi . | |

FOREIGN PATENT DOCUMENTS

| | | | |
|---|---|---|---|
| 423545 | 1/1926 | Germany | 418/227 |

*Primary Examiner*—Michael Koczo
*Attorney, Agent, or Firm*—Ridout & Maybee

[57] ABSTRACT

The invention is an air compressor and a gas expander. The compressor/expander has an inner chamberwall-forming member attached eccentrically to a drive shaft and being rotatable with it, an outer chamberwall-forming member attached eccentrically to the drive shaft and being rotatable with it, and a plurality of stator vanes positioned concentrically about the drive shaft between the inner and outer chamberwall-forming members. The stator vanes are each rotatable about an axis extending parallel to the drive shaft. The inner and outer chamberwall-forming members and stator vanes coact to define a plurality of chambers which vary in size with the rotation of the stator vanes and the chamberwall-forming members. A stationary end wall for the compressor/expander provides a stationary end wall for each chamber, and valve means are positioned in the stationary end wall of the compressor/expander to enable the inflow and outflow of air into and out of each chamber. The invention may be combined with a combustion chamber to make a rotary engine.

12 Claims, 5 Drawing Sheets

GAS COMPRESSOR/EXPANDER

The invention is a rotary gas compressor/expander. The invention may be used with a combustion chamber to make a rotary engine. As a rotary engine, the air intake and compression function is provided by the invention operating as a gas compressor, and the engine is powered by the expansion of combustion gases in the invention operating as a gas expander.

The internal combustion reciprocating engine is only about 25% fuel efficient with about one third of the energy produced by the fuel combustion being lost to exhaust. Further, incomplete fuel combustion, unnecessarily high levels of fuel consumption, noise and vibration in reciprocating engines are undesirable for most applications and create a serious pollution problem.

The invention addresses these and other problems associated with the conventional internal combustion reciprocating engine by providing a gas expander for a rotary engine that efficiently utilizes the energy that results from the combustion of a fuel to impart rotary motion to a drive shaft. An engine incorporating the compressor/expander device of the invention accomplishes this objective by producing a complete fuel combustion in a combustion chamber using a pressurized mixture of fuel and air. The combustion of the fuel/air mixture creates a gas mixture having a high pressure and temperature which when exhausted through a gas expander of the invention rotationally affixed to a drive shaft provides an efficient transfer of the energy of combustion as the mechanical energy of the engine. In accordance with the invention, this mechanical energy or driving force of the engine is provided with much less accompanying pollution, noise and vibration than is possible with the conventional internal combustion piston engine.

Accordingly, the invention provides an air compressor and a gas expander. The compressor/expander comprises an inner chamberwall-forming member attached eccentrically to a drive shaft and being rotatable with it, an outer chamberwall-forming member attached eccentrically to the drive shaft and being rotatable with it, and a plurality of stator vanes positioned concentrically about the drive shaft between the inner and outer chamberwall-forming members. The stator vanes are each rotatable about an axis extending parallel to the drive shaft. The inner and outer chamberwall-forming members and stator vanes coact to define a plurality of chambers which vary in size with the rotation of the stator vanes and the chamberwall-forming members. A stationary end wall for the compressor/expander provides a stationary end wall for each chamber, and valve means are positioned in the stationary end wall of the compressor/expander to enable the inflow and outflow of air into and out of each chamber.

While the gas compressor/expander of the invention has a variety of uses, it will be described in detail hereinafter in the context of its use in a rotary engine. A preferred rotary engine utilizing the invention comprises the device in both its gas compression and gas expanding modes, and thus, is a particularly apt application of the advantages provided by the invention.

BRIEF DESCRIPTION OF THE DRAWINGS

The essential elements of a compressor/expander of the invention are shown in FIGS. 1–4. As seen in FIG. 5, a rotary engine comprises an air compressor 10 attached to a drive shaft 12. The compressor 10 supplies compressed air to a combustion chamber 15 in which a fuel is burned using oxygen from the compressed air, thereby producing exhaust gas having an elevated temperature and pressure which is conveyed to a gas expander 17 also being attached to the drive shaft 12. The gas expander 17 is sized to accommodate the high pressure gases exhausted from the combustion chamber 15 so that the expansion of such gases in the expander 17 will provide an optimal transfer of energy from the exhaust gases to drive the shaft 12.

Referring to FIGS. 1 and 2, a compressor 10 has an inner chamberwall-forming member 20 and an outer chamberwall-forming member 22 both attached eccentrically to the drive shaft 12 and being rotatable with it. Preferably, the inner and outer chamberwall-forming members 20 and 22 are joined together by an end wall 24. The combined chamberwall-forming members 20 and 22 are attached to the drive shaft 12 by, for example, a rib 27 and keyway 28 arrangement as shown in FIG. 1.

A plurality of stator vanes 30 are positioned concentrically about the drive shaft 12 between the inner and outer chamberwall-forming members 20 and 22. Each stator vane 30 is rotatable on a shaft 31 extending parallel to the drive shaft 12. The inner and outer chamberwall-forming members 20 and 22, and the stator vanes 30 coact to define a plurality of chambers about the drive shaft 12. As shown in FIG. 2, six stator vanes 30 coact with the chamberwall-forming members 20 and 22 to define six chambers 33-38 about the drive shaft 12.

Figure 1:
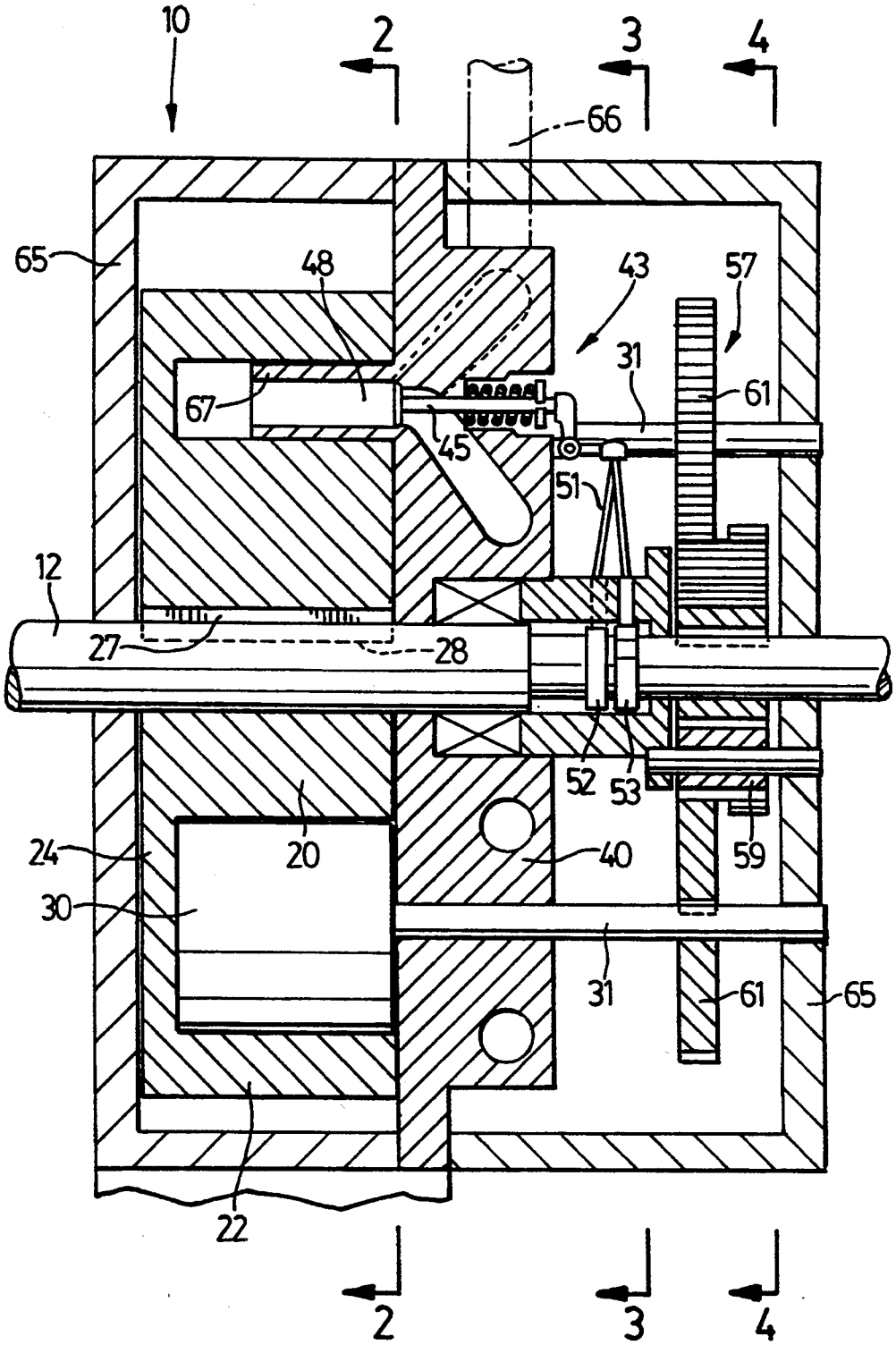
FIG. 1 is a cross sectional view of a gas compressor or expander of the invention taken along section 1—1 of FIG. 2.

A stationary end wall 40 for the compressor 10 is in opposition to the end wall 24 for each chamber 33–38. The shafts 31 for the stator vanes 30 extend through the end wall 40, and valve means 43 are positioned in the end wall 40 to provide the inflow and outflow of air into and out of each chamber 33–38.

Figure 3:
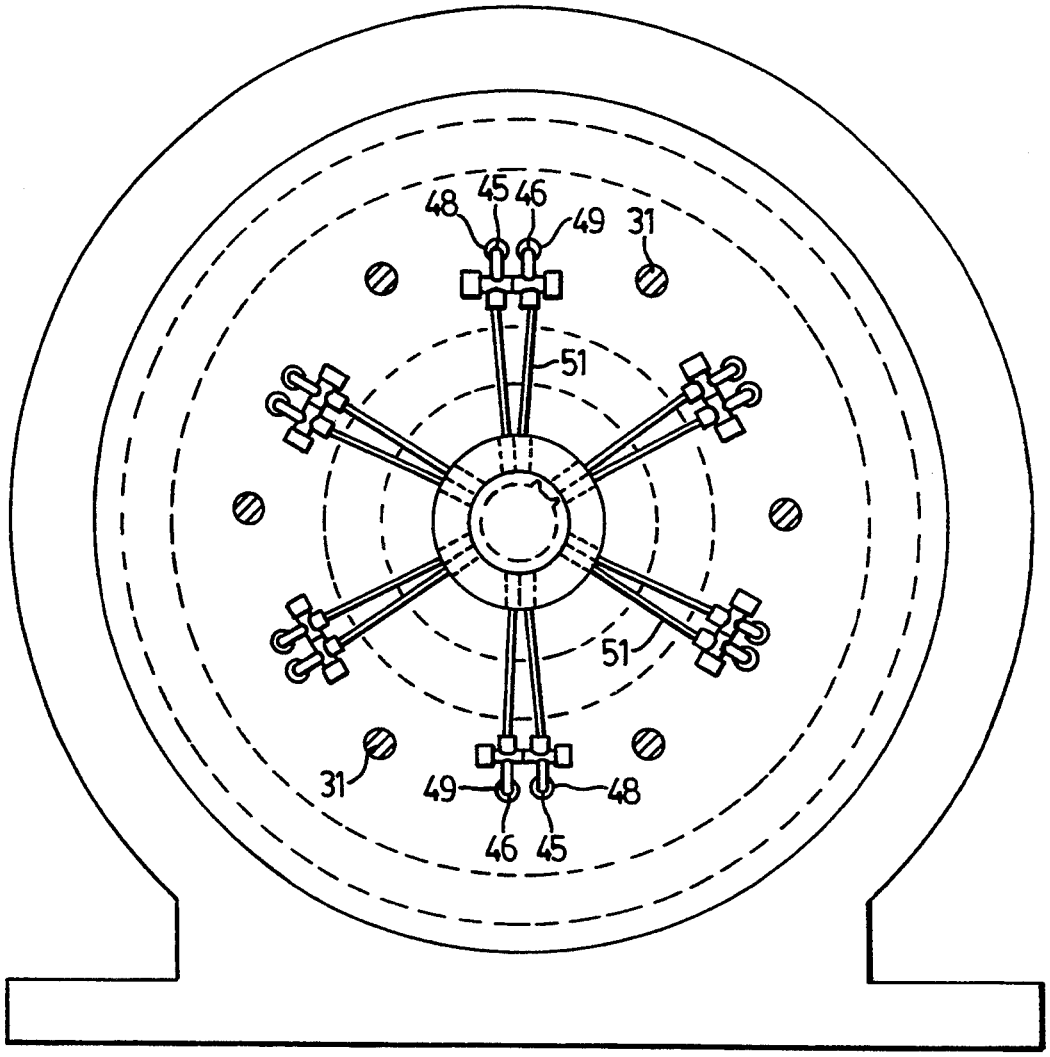
FIG. 3 is a sectional view taken along line 3—3 of FIG. 1 showing a valve system for the device.
Figure 4:
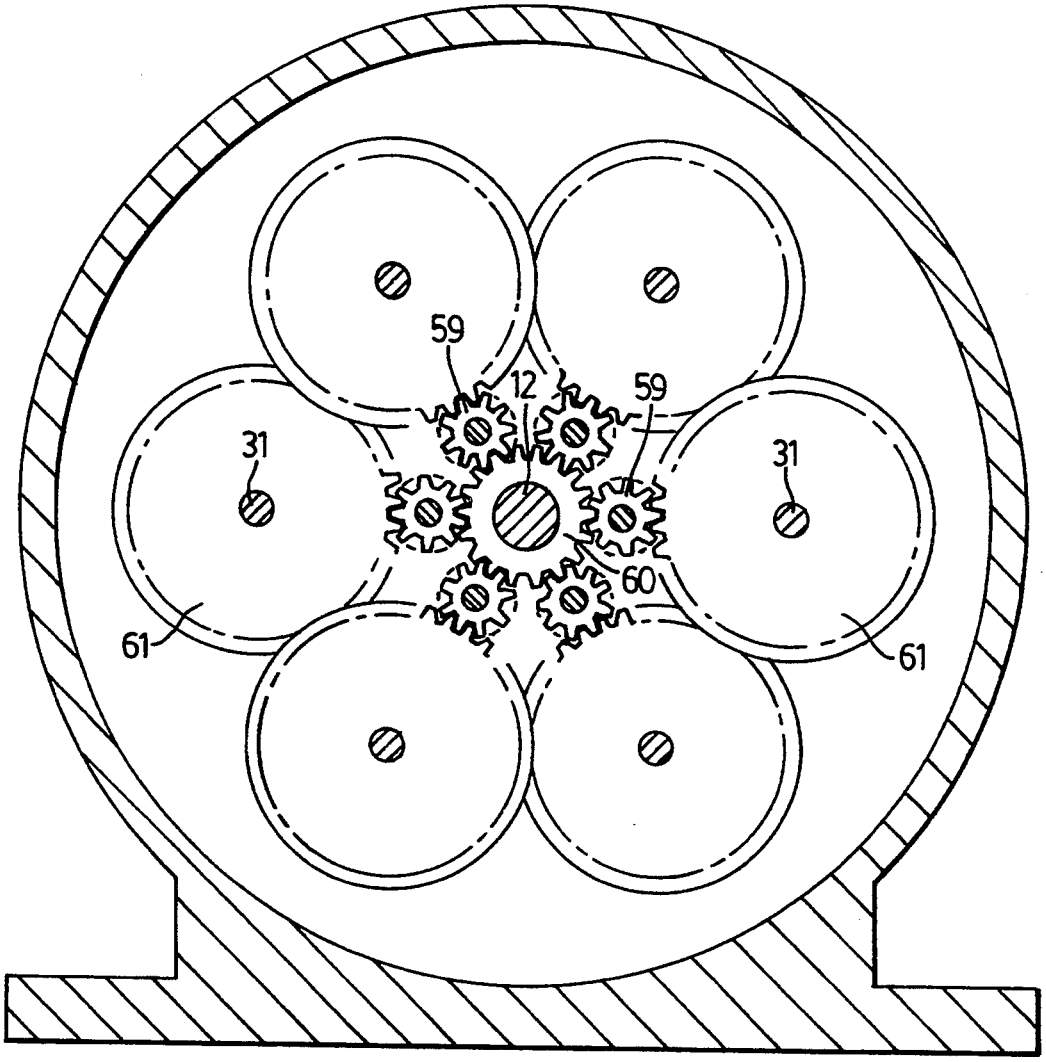
FIG. 4 is a sectional view taken along line 4—4 of FIG. 1 showing a gearing arrangement for the device.

Suitable valve means 43 will be apparent to those skilled in the art, and a representative poppet valve arrangement is illustrated in FIGS. 1 and 3. Thus, inlet and outlet valves 45 and 46 are seated in ports 48 and 49 at the end wall 24 of each chamber 33–38. The valves 45 and 46 are operated by a rocker arm assembly 51 activated by cams 52 and 53 affixed to the drive shaft 12.

The rotation of the stator vanes 30 is governed by a gearing arrangement 57 so that each stator vane 30 rotates 180° for each complete rotation of the drive shaft 12. Since the stator vanes 30 must rotate in the same direction as the drive shaft 12, appropriate gearing such as the use of planetary gears 59 between the drive gear 60 on the drive shaft 12 and the gears 61 attached to each stator vane shaft 31. Other suitable gearing arrangements for the stator vanes 30 will be apparent to the skilled person.

Preferably, the compressor 10 is enclosed by a housing 65 through which the drive shaft 12 extends as do conduits for the intake and exhaust of air. An exhaust conduit 66 is shown in FIG. 1.

Figure 2:
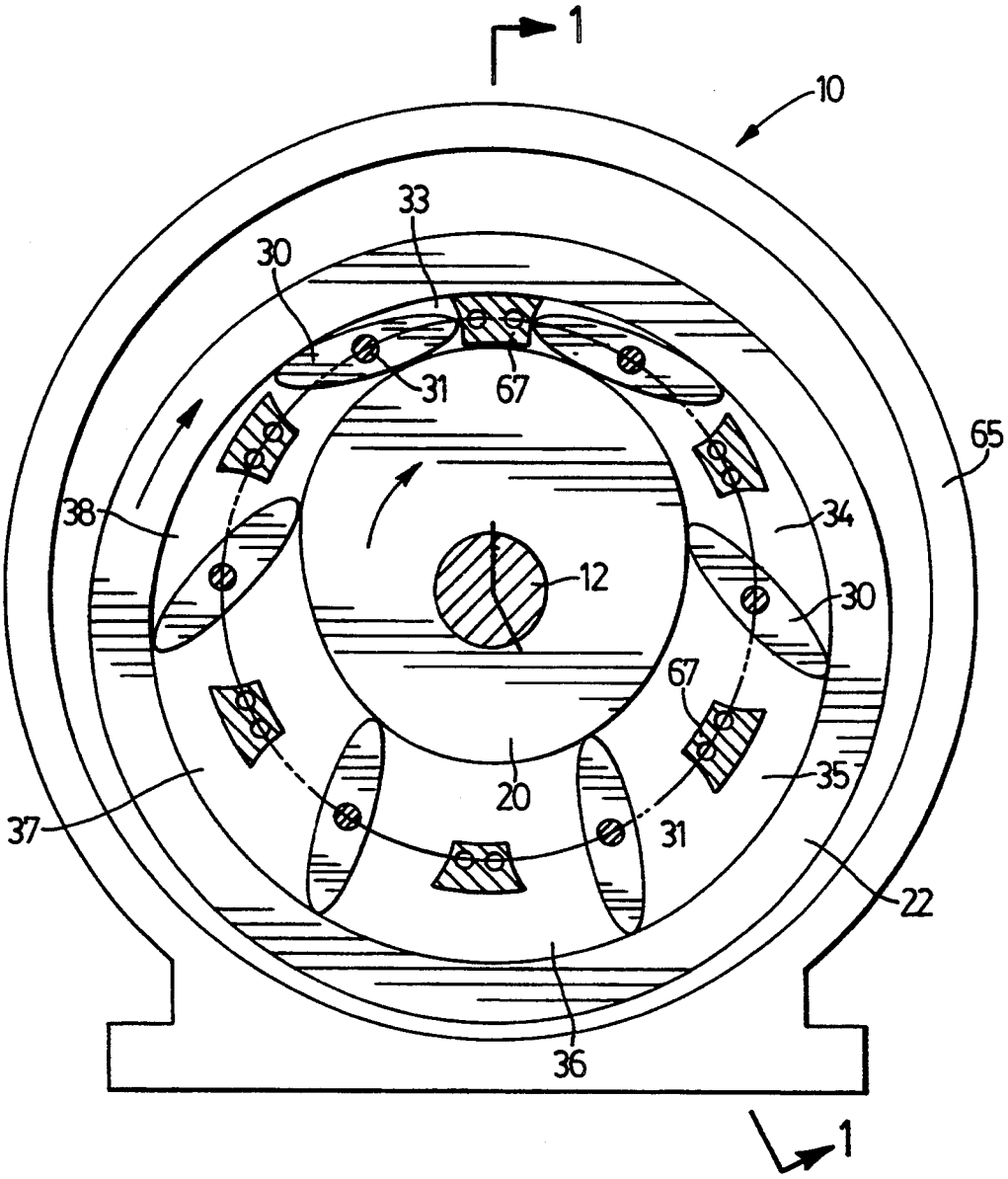
FIG. 2 is a sectional view taken along line 2—2 of FIG. 1 showing the configuration of rotary elements of the device.

In operation, the stator vanes 30 and the inner and outer chamberwall-forming members 20 and 22 all rotate in the same direction causing the continuous expansion and contraction of air volume in each chamber 33–38. In the embodiment illustrated, each of the six chambers 33–38 during one cycle of the drive shaft 12 proceeds from a minimum volume configuration (e.g., chamber 33, FIG. 2) in which the compressed air in that chamber is exhausted to the combustion chamber 15, through an intake stage of a half cycle of the drive shaft 12 (e.g., to chamber 36, FIG. 2) followed by a compression stage of one half cycle (e.g., back to chamber 33, FIG. 2) to exhaust. As shown in FIGS. 1 and 2, it is thought to be preferable to provide each chamber 33–38 with a valve port block 67 which acts to further reduce the free volume of each chamber 33–38, thereby providing a greater compression of air by the exhaust stage of the cycle.

Figure 5:
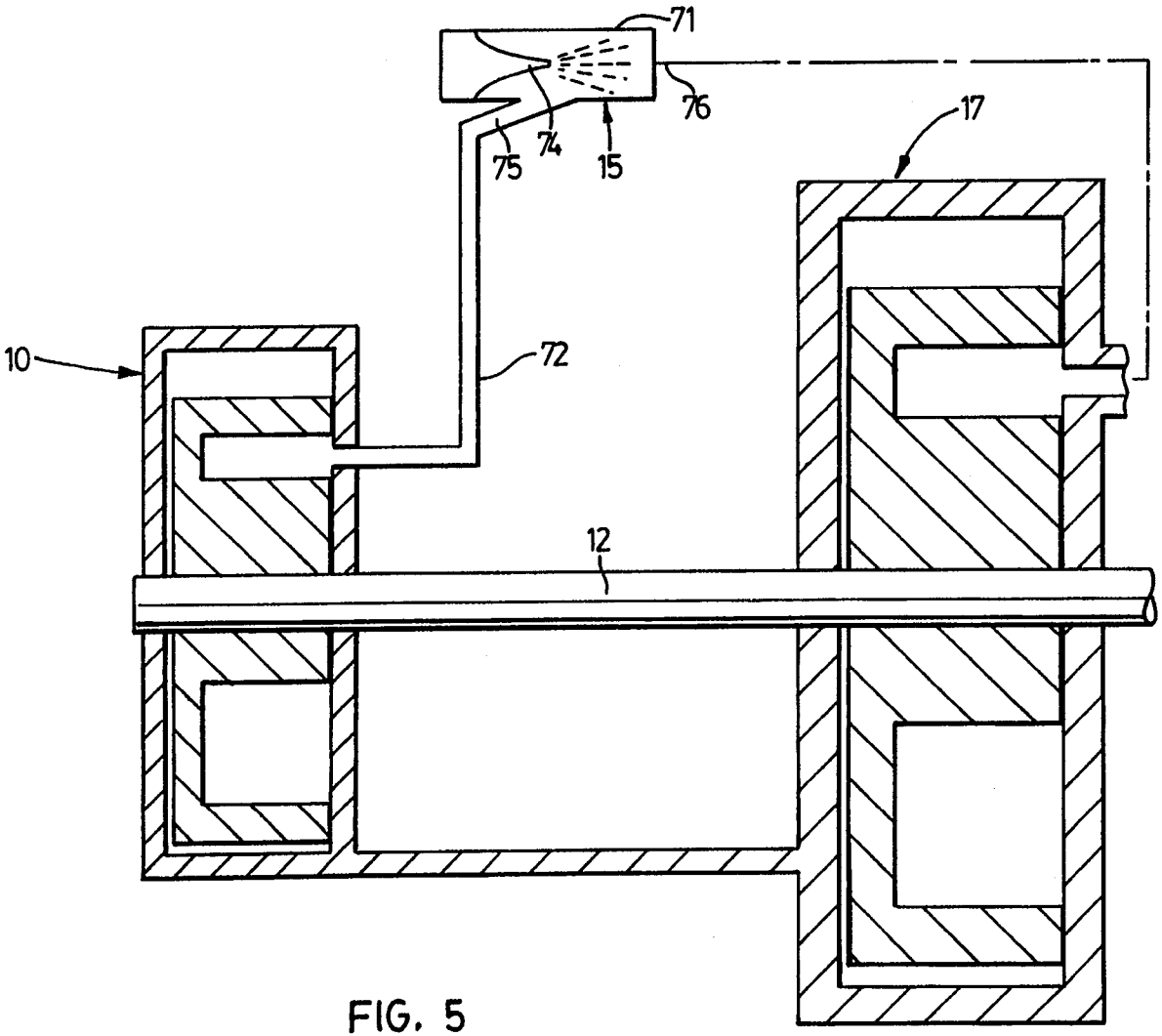
FIG. 5 is a schematic cross sectional view of a rotary engine utilizing a compressor and an expander of the invention.

As schematically shown in FIG. 5, compressed air from the compressor 10 is conveyed to the combustion chamber 15 where it provides oxygen for the combustion of a fuel. The chamber 15 has walls 71 defining a fixed volume and is in flow communication with the compressor 10 by, for example, a conduit 72. The combustion chamber 15 has fuel injection and ignition means 74, an inlet 75 for compressed air from the compressor 10, and an outlet 76 for exhaust gases of combustion. The combustion chamber 15 is sized and configured for the purpose to be compatible with the compressor 10 and gas expander 17, and as such, a suitable design for the combustion chamber 15 will be apparent to the skilled person.

Exhaust gases from the combustion chamber 15 having a high temperature and pressure are conveyed to the gas expander 17 which is structurally the same as the compressor 10, but larger. It is the expansion of gases in the expander 17 which provides the driving force for the engine. Thus, the expansion of gases in the expander 17 proceeds in stages opposite to the stages for air compression in the compressor 10 described above. Referring to FIG. 2, high pressure gas flows from the combustion chamber 15 to a chamber of the expander 17 having its minimum free volume (e.g., chamber 33 in FIG. 2). The gas expands for one half cycle of the drive shaft 12, thereby transferring energy through the inner and outer chamberwall-forming members 20 and 22 to the drive shaft 12, at which point it is exhausted to the atmosphere during the second half cycle of the drive shaft 12 back to the point of intake.

While the basic principles of the invention have been described with reference to the particular embodiment shown, the skilled person will understand that the invention may be alternatively configured, and the scope of the invention should not be limited by this disclosure.

I claim:

1. A gas compressor/expander, comprising:

an inner chamberwall-forming member attached eccentrically to a drive shaft and being rotatable with it, an outer chamberwall-forming member attached eccentrically to the drive shaft and being rotatable with it, and a plurality of stator vanes positioned concentrically about the drive shaft between the inner and outer chamberwall-forming members, the stator vanes each being rotatable about an axis extending parallel to the drive shaft, the inner and outer chamberwall-forming members and stator vanes coacting to define a plurality of chambers which vary in size with the rotation of the stator vanes and the chamberwall-forming members;

a stationary end wall for the compressor/expander providing a stationary end wall for each of the chambers; and valve means in the stationary end wall for enabling the inflow and outflow of air into and out of each chamber.

2. A compressor/expander as claimed in claim 1, wherein the inner and outer chamberwall-forming members are joined by an end wall to provide a integral structure.

3. A compressor/expander as claimed in claim 1, further comprising a valve port member located centrally in each chamber, each valve port member defining inlet and outlet ports for each chamber and serving to reduce the free volume of each chamber.

4. A compressor/expander as claimed in claim 1, further comprising gear means between the drive shaft and the stator vanes for causing the stator vanes to rotate with the rotation of the drive shaft so that each vane rotates in the same direction as the drive shaft but at a ratio of one half cycle per full cycle of the drive shaft.

5. A compressor/expander as claimed in claim 1, wherein the valve means for each chamber of the compressor provide an intake stage of one half cycle of the drive shaft followed by a compression stage of one half cycle of the drive shaft, and the valve means for each chamber of the gas expander provide a gas expansion stage of one half cycle of the drive shaft followed by an exhaust stage of one half cycle of the drive shaft.

6. A compressor/expander as claimed in claim 1, further comprising a housing enclosing the chamberwall-forming members.

7. A rotary engine having a drive shaft, comprising:

an air compressor attached to the drive shaft, the compressor comprising:

an inner chamberwall-forming member attached eccentrically to the drive shaft and being rotatable with it, an outer chamberwall-forming member attached eccentrically to the drive shaft and being rotatable with it, and a plurality of stator vanes positioned concentrically about the drive shaft between the inner and outer chamberwall-forming members, the stator vanes each being rotatable about an axis extending parallel to the drive shaft, the inner and outer chamberwall-forming members and stator vanes coacting to define a plurality of chambers which vary in size with the rotation of the stator vanes and the chamberwall-forming members;

a stationary end wall for the air compressor providing a stationary end wall for each of the chambers; and valve means in the stationary end wall for enabling the inflow and outflow of air into and out of each chamber;

a combustion chamber being in flow communication with the air compressor, the combustion chamber having walls defining a fixed volume, and comprising:

fuel injection means for introducing a combustible fuel into the combustion chamber;

compressed air inlet means connected to the air compressor for introducing compressed air into the combustion chamber concurrently with the injection of fuel into it;

ignition means for igniting the air and fuel mixture in the combustion chamber; and exhaust gas outlet means for exhausting the combusted fuel and air mixture from the combustion chamber; and a gas expander attached to the drive shaft and being in flow communication with the combustion chamber, and the expander comprising:

an inner chamberwall-forming member attached eccentrically to the drive shaft and being rotatable with it, an outer chamberwall-forming member attached eccentrically to the drive shaft and being rotatable with it, and a plurality of stator vanes positioned concentrically about the drive shaft between the inner and outer chamberwall-forming members, the stator vanes each being rotatable about an axis extending parallel to the drive shaft, the inner and outer chamberwall-forming members and stator vanes coacting to define a plurality of chambers which vary in size with the rotation of the stator vanes and the chamberwall-forming members;

a stationary end wall for the expander providing a stationary end wall for each of the chambers; and valve means in the stationary end wall of the expander for enabling the inflow and outflow of gas into and out of each chamber;

the gas expander operating to receive compressed exhaust gases from the combustion chamber and to impart rotational motion to the drive shaft through the expansion of such gases therein.

8. A rotary engine as claimed in claim 7, wherein the inner and outer chamberwall-forming members are joined by an end wall to provide a integral structure.

9. A rotary engine as claimed in claim 7, further comprising a valve port member located centrally in each chamber of the compressor and the expander, each valve port member defining inlet and outlet ports for each chamber and serving to reduce the free volume of each chamber.

10. A rotary engine as claimed in claim 7, further comprising gear means between the drive shaft and the stator vanes for causing the stator vanes to rotate with the rotation of the drive shaft so that each vane rotates in the same direction as the drive shaft but at a ratio of one half cycle per full cycle of the drive shaft.

11. A rotary engine as claimed in claim 7, wherein the valve means for each chamber of the compressor provide an intake stage of one half cycle of the drive shaft followed by a compression stage of one half cycle of the drive shaft, and the valve means for each chamber of the gas expander provide a gas expansion stage of one half cycle of the drive shaft followed by an exhaust stage of one half cycle of the drive shaft.

12. A rotary engine as claimed in claim 7, further comprising a housing enclosing the chamberwall-forming members of each of the compressor and expander.

* * * * *